United States Patent [19]

Shiga et al.

[11] 4,420,377

[45] Dec. 13, 1983

[54] METHOD FOR CONTINUOUSLY ELECTROPLATING WIRE OR THE LIKE AND APPARATUS THEREFOR

[75] Inventors: Shoji Shiga; Akitoshi Suzuki; Yasuo Goma; Kenji Kawada, all of Nikko, Japan

[73] Assignee: The Furukawa Electric Company, Ltd., Tokyo, Japan

[21] Appl. No.: 260,779

[22] Filed: May 5, 1981

[51] Int. Cl.[3] ..... C25D 7/06; C25D 17/06

[52] U.S. Cl. ..... 204/28; 204/206; 204/209

[58] Field of Search ..... 204/28, 206, 207, 208, 204/209, 210, 211

[56] References Cited

U.S. PATENT DOCUMENTS

| | | | |
|---|---|---|---|
| 2,737,487 | 3/1956 | Rayburn | 204/206 |
| 2,762,763 | 9/1956 | Kenmore et al. | 204/28 |
| 3,676,322 | 7/1972 | Kamata et al. | |
| 3,867,265 | 2/1975 | Hansson | 204/28 |
| 3,919,069 | 11/1975 | Ascher | 204/206 |

*Primary Examiner*—G. L. Kaplan
*Assistant Examiner*—William Leader
*Attorney, Agent, or Firm*—Armstrong, Nikaido, Marmelstein & Kubovcik

[57] ABSTRACT

Method and apparatus for continuously electroplating wire or the like wherein two or more drums combine a power supply with a wire turn direction, each drum having a vertical and rotatable shaft, are provided; a wire or the like to be electroplated is wound on the drums in multiple stages so as to be run; an electroplating cell is positioned between the drums so that the wire to be electroplated is arranged to pass in and out of the electroplating cell in multiple stages and repeatedly; and, particularly, an end of the electroplating cell is provided with a slit for passage of the wire to be electroplated, the slit being provided with weir plates placed one on top of another such that the weir plates put each of wires in multiple stages running through the electroplating cell between upper and lower weir plates and passage holes for running the wires at multiple stages are formed at joints between individual weir plates.

14 Claims, 8 Drawing Figures

METHOD FOR CONTINUOUSLY ELECTROPLATING WIRE OR THE LIKE AND APPARATUS THEREFOR

BACKGROUND OF THE INVENTION

The present invention relates to an improved method and apparatus for mass-producing an electroplated wire or the like of high quality at high efficiency.

There is a great industrial demand for electroplating the conductive metal wires of various kinds or the like. The electroplating of a certain thickness requires a definite time for the electroplating which is determined by the kind of the electroplating bath and other conditions thereof. Therefore, the requirement of a thick plating and/or a high line-speed for the purpose of the mass-production makes it necessary to maintain the wire or the like to be treated in the electroplating bath over a long distance.

On that occasion, since the amount of electricity supplied to the wire to be treated is defined by the diameter of the wire and the conductivity, it is necessary to feed electricity to the wire from a plurality of power sources by division.

Accordingly, there has been generally used the electroplating apparatus which runs the wire horizontally and has scores of the plating cells arranged in series, and a power supply section between the cells. However, such electroplating apparatus requires a large space and is disadvantageous economically.

Then, there might be the arrangement of running the plural wires in parallel to each other through the same cell in order to reduce the number of cells. In this case, many expensive devices for both pay-out and take-up are necessary if the number of cells is reduced, and therefore the problem is not satisfactorily solved.

Under these circumstances, the following apparatus have been proposed by the Japanese examined publication Sho No. 46-22082, U.S. Pat. No. 3,676,322 to Kamata and B. Pat. No. 1,302,793 in which the wire to be treated is wound on a pair of drums having a vertical and rotatable shaft respectively in multiple stages and made to pass many times through the electrolytic treatment cell positioned between the drums while power is supplied to the wire through the drums.

Further, in addition to the above apparatus, a method in which more than three drums are arranged circularly and electroplating is carried out by winding the wire on these drums.

The method using the vertical and rotatable drums in Japanese examined publication Sho No. 48-34286 proposes industrially more advantageous means than those using the horizontal and rotatable drums because in the former method the anodes are arranged on the right and left sides in the electrolytic cell to put the wire to be treated therebetween and further are supplemented and exchanged from the upper part of the cell.

In the method using vertical and rotatable drums, in order to keep the wires in multiple stages guided in and out of the electrolytic cell with a height between the wires sufficient to immerse those wires in the electrolyte of the cell, the wires are pressed by the elastic packing such as rubber and plastics on both sides of the wires at the end of the cell to close up. The method of pressing the packing to the wires directly causes the troubles on the quality, such as scratches and cracks formed on the surface of the wire, and foreign matters entrained on the surface of the wire and mixing into the plating during the process of the plating.

On the other hand, the number of the turns per pair of drums is limited by the operational problem that wires wound are entangled by change of wire tension.

Then, the method of passing the wires in multiple stages through a narrow slit instead of the packing has been tried but rather resulted in increased entanglement of the wires in most cases.

As mentioned above, the amount of the wire to be wound on a pair of the vertical and rotatable drums is practically limited and the method is unfavorable to the mass-production.

Then, the arrangement of employing more than three drums may be thought of. In this case, the number of electroplating tanks is increased in proportion to the number of the drums and, on the other hand, the winding angle of the wire to the drums is decreased such that the electric supply to the wire becomes improper and the production quantity is naturally limited.

OBJECTS OF THE INVENTION

The present invention aims to cope with the above.

(1) Thus, it is an object of this invention to improve the quality and productivity of the product being obtained by the conventional methods.

(2) Another object of the invention is to provide a large scale equipment that is capable of accomplishing the electroplating of the wire with a thick plating of a high quality in a high line-speed.

(3) Another object of the invention is to maximize the electroplating production quantity per group of drums composed of a pair of drums or three or more drums arranged circularly and realize a large-scale mass-production system from the method and the apparatus by means of arranging the above groups of drums in series.

(4) Another object of the invention is to prevent bending fatigue at the welded portion of wires inevitable to the continuous plating of the wires so as to achieve the above large-scale mass-production system.

(5) Another object of the invention is to realize a minute plating by means of preventing the occurrence of various defects harmful to the plating quality.

(6) Still another object of the invention is to provide a method and an apparatus for realizing the above objects without the complications of the heretofore known plating operations.

(7) The above and further objects and novel features of the invention will be clarified in the following description of the preferred embodiments, and the novel features will be particularly pointed out in the appended claims when read in connection with the accompanying drawings. It is to be expressly understood, however, that the drawings are not to be used as a definition of the invention, but are for illustration only.

BRIEF SUMMARY OF THE INVENTION

This invention provides a method and apparatus as follows:

A continuous electroplating method for wire or the like is provided comprising the steps wherein at least one group of vertical drums comprise two or more drums and is combined with an electric power supply and at least a wire direction turn. Each drum has a vertical and rotatable shaft. A conductive wire or the like, as a wire to be electroplated, is wound and run on the drums spirally and stepwise from the bottom toward the top in multiple stages. The conductive wire is arranged to pass and run multi-stepwise and repeatedly through an electrolyte of an electroplating electrolytic cell positioned between the drums, and an end of the electroplating electrolytic cell is provided between the drums of at least one group with a vertically oriented slit which has a plurality of horizontally oriented weir plates that are placed, one on top of the other, within the slits at each end of the cell, including one through which the wire enters and one through which the wire exits, for the passage of the conductive wire. The slit is closed with piled-up, weir plates which are longer sideways than they are vertically in such a manner that the weir plates put each of the multi-stepwise running conductive wires in multiple stages running through the cell between the upper and lower plates. The weir plates have a vertically oriented line of wire holes for running the conductive wires in multiple stages that are respectively formed at joint surfaces between individual adjacent weir plates. In addition, a method is provided wherein the conductive wire or the like is drawn previously. Also, the weir plates in the wire circumference.

BRIEF DESCRIPTION OF THE DRAWINGS

In the drawings, wherein like elements are referenced alike.

Figure 1:
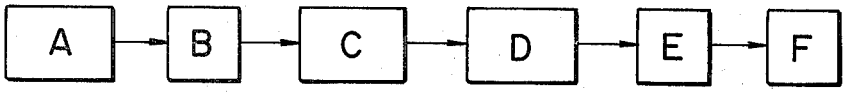
FIG. 1 is a block diagram indicating a general manufacturing process of the wire or like to be electroplated according to the method and apparatus of the present invention.

DETAILED DESCRIPTION OF THE PREFERRED EMBODIMENTS OF THE METHOD AND APPARATUS FOR CARRYING OUT THE INVENTION

The invention is described in detail by the method and apparatus utilizing the groups of drums, each comprising a pair of vertical and rotatable drums as shown in the drawing but needless to say, can be applied in theory the same way to the case in which three or more of the vertical and rotatable drums are used.

The continuous electroplating equipment applied to the wire or the like of the invention is described with reference to FIG. 1 of the process diagram. The invention comprises the following processes: the coiled wire is uncoiled at the pay-out section (A), drawn at the drawing section (B), washed and/or activated on the surface thereof at the pre-treatment section (C) and subject to the electroplating as required at the plating section (D). Then, the wire is subject to the post-treatment such as drying, etc. at the post-treatment section (E) and recoiled at the take-up section (F).

Next, the plating section (D) most characterized in this invention is described in detail.

Figure 2:
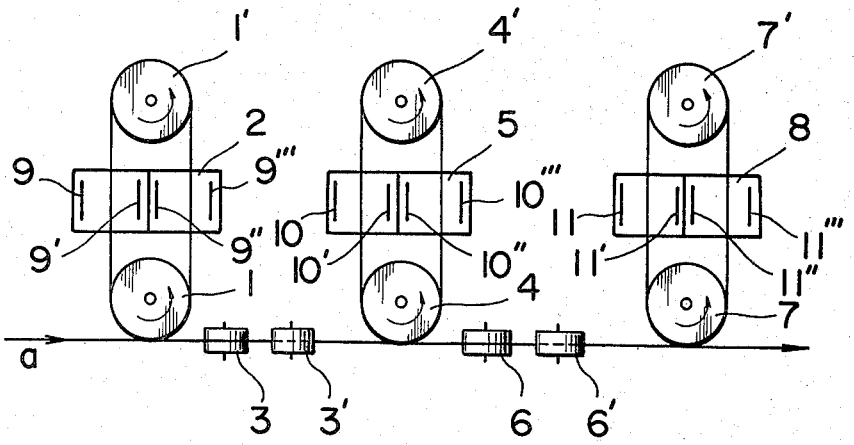
FIG. 2 is a plan view explaining the embodiment of the electroplating equipment of the invention.
Figure 3:
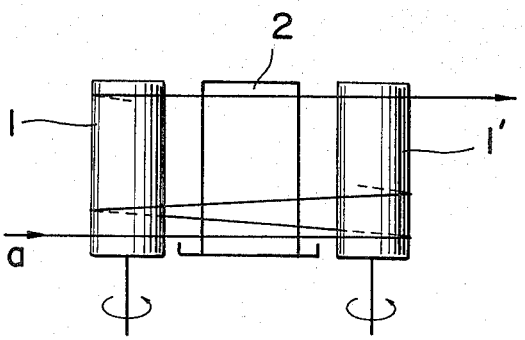
FIG. 3 is a side view explaining a group of drums in FIG. 2.
Figure 4:
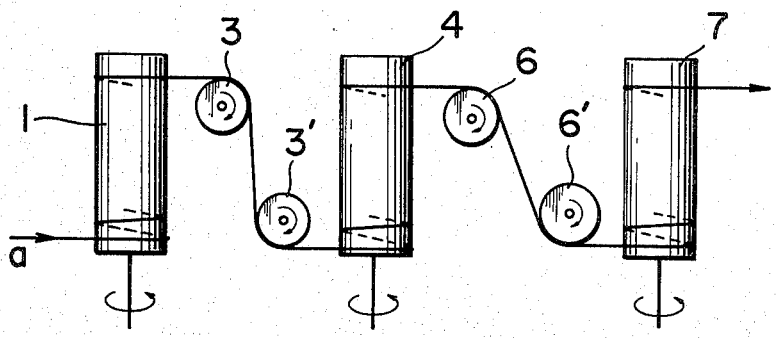
FIG. 4 is a front view indicating a mutual relationship among groups of drums.

FIGS. 2 through 4 indicate an equipment example of the plating section (D) of the invention which is composed of three groups of drums, each group having a pair of vertical and rotatable drums, arranged in series.

It is needless to say that a part of the three groups may be used as the process of the pre-treatment section (C) or the post-treatment section (E).

The wire to be treated (a) is suspended on the bottom steps of a pair of the vertical and rotatable drums (1) and (1') and successively wound on the drums at multiple stages to ascend in a spiral staircase as shown in FIG. 3, and passes-through the electrolytic cell (2) repeatedly during the ascent, thereby being subjected to a plurality of the plating treatments, and then reached to the top step of the drums (1) and (1') to enter into the next group of the drums (4) and (4').

The drums (1) and (1') may be driven as required and serve as both for the wire turn direction and the contact of the electric supply to the wire since the drums (1) and (1') are connected to the cathode side of the power source and are provided with concave grooves on the cylindrical surface thereof circumferentially at the multiple stages so as to place the wire to be treated therein, thereby achieving the function smoothly.

The wire to be treated (a) that has reached top steps of the drums (1) and (1') of the first group is guided into the bottom steps of the drums (4) and (4') of the second group through the different level rolls (3) and (3') interposed between the first and second groups as shown in FIG. 4.

The group of the different level rolls is composed of the rolls each provided with a horizontally rotatable shaft, and the diameter and the number of the roll are appropriately selected since the deformation due to the excessive difference of the level damages the wire and the surface thereof.

The wire (a) that has entered into the second group of drums is electroplated in the same manner as mentioned above and then enters into the third group of the drums (7) and (7').

The power required for the running of the above wire to be treated may rely on the coiling-up force of the re-coiler section (F), but relies on the drive of the drums themselves in most cases.

Since the drum groups are arranged in series as mentioned above, the arrangement for the groups of the different level rolls (3) and (3'), and (6) and (6') aforementioned is inevitable practically on account of the work at the start-up time.

In order to successively wind the wire from the top step of the former drum group to the bottom step of the latter drum group at the start-up time, for example, these drum groups may be raised in a level serially in a staircase shape, but this way is not preferable since it makes the equipment construction and the operation complicated.

Further, the drum groups may be individually arranged in such a manner that the wires are respectively set at the bottom step of the drum group at the odd number and set at the top step of the drum group at the even number, at the start-up time, and the wires are joined by welding between the top steps or the bottom steps of the adjacent drum groups. This way not only complicates the work but also is unfavorably feared to produce the fatigue and breaking of the welding portion owing to the plurality of windings.

In the electroplating cells (2), (5) and (8), the anodes (9), (9'), and (9'') and (9'''); (10)~(10''') and (11)~(11''')

are connected with the positive side of the plating power source, which is positioned at both sides of the wire to be treated (a) so as to be put therebetween, and the electrolyte is filled in the tanks. The construction for the end of the tank through which the wire (a) passes in and out is shown in FIG. 5 as an example.

In other words, there is a slit (13) provided on the end surface (12) of the electroplating cell (2) in which the weir plates (14) which are longer sideways and also serve as separators are fitted to be put one over another in multiple stages so as to put the wire (a) running in multiple stages between respective upper and lower weir plates, and the passage holes (15) of the wire to be treated (a) are formed at the joints of the respective weir plates (14).

Figure 5:
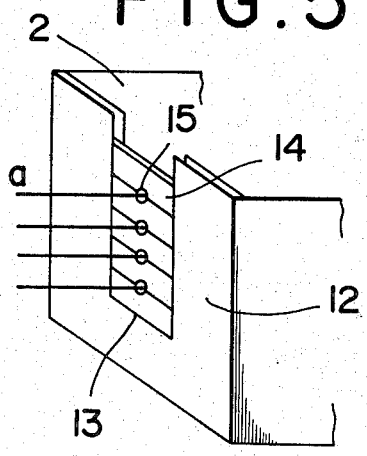
FIG. 5 is a perspective view indicating the weir plate portion of the electroplating cell in connection with the embodiment of the invention.
Figure 6:
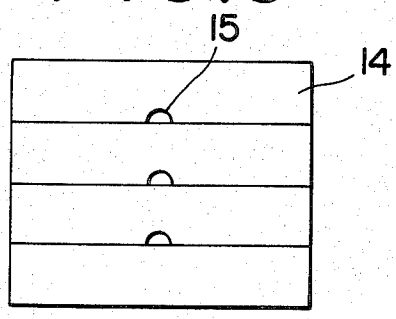
FIGS. 6 and 7 are plane embodiments explaining the weir plate portions and other embodiments.
Figure 7:
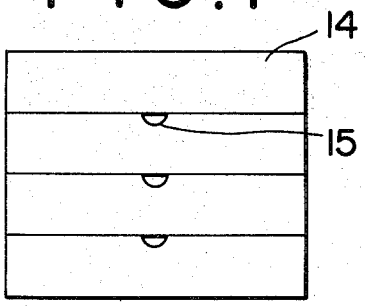

The passage holes (15) may be formed by respective semicircular grooves provided at the joints of the weir plates (14) so as to make a circle as in FIG. 5 and by a semicircular groove provided at either one of the weir plates (14) joined as in FIGS. 6 and 7.

The shape of the passage holes (15) is selected optionally, and the size of the holes is to be larger than the diameter of the wire to be treated and preferably large enough to have no contact of the wire with the hole even at some variations of the wire position during running. However, the excessively large holes increase the outflow of the electrolyte and result in difficulty of maintaining the necessary level of the liquid surface of the plating cell (2).

The above weir plates (14) are made of the materials being not deteriorated by the electrolyte and non-conducting electrically, in which a ceramic sinter of alumina, zirconia, boron nitride, silicon nitride, etc. is particular most suitable.

The weir plates (14) are preferably smoothly finished at the surface to prevent roughness at the portions of the passage holes (15) at least. The requirement is necessary to prevent the wear due to the contact with the wire (a) and simultaneously prevent scoring and stain on the electroplated surface of the wire (a).

As a material for the weir plates, plastic such as the polyvinyl chloride, for example, may be usable, but is unfavorable in point of quality when compared with the ceramic sinter since such plastics may wear when in contact with the electroplated surface of the wire (a) and adhere to the electroplated surface, and then may be taken into the interior of the plating.

When the number of turns or the running stage of the wire in an electrolytic cell is increased, the liquid surface of the electrolyte is elevated and the outflow of the electrolyte out of the passage holes (15) of the weir plates (14) is increased, and therefore the weir plates (14) are provided in two or more rows in a running direction of the wire for the effective use.

The action and effect of the invention in use of the weir plate longer sideways are superior in comparison with those of the conventional method as mentioned in following description.

(1) In case of the wire passing through the slit kept intact without using the weir plates, the outflow of the electrolyte becomes excessive and makes it difficult to maintain the required level of the electrolyte surface, and therefore the winding number of the wire to the drum is remarkably limited. It is more important that, in this case, the wire tension varies to loosen the wire so that the wire at the upper stage drops out of the groove of the drum and is entangled with the wire at the lower stage, thereby making the running of the wire impossible.

Figure 8:
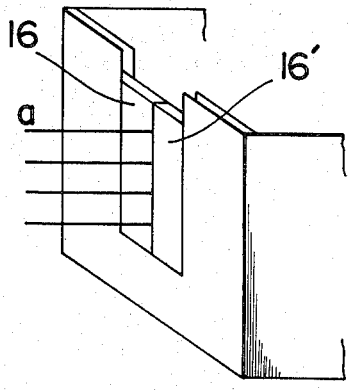
FIG. 8 is a perspective view explaining the packing portion of the electroplating cell of the conventional technique in comparison with FIG. 5.

(2) In case of packing the wire (a) with the elastic plates (16) and (16') such as rubber and foamed plastics by pressing at both sides as shown in FIG. 8, the maintenance of the liquid surface level may be achieved but the entanglement of the wires is not prevented completely. Further, it is a serious matter that the electroplating defects are brought about as mentioned above.

(3) To the contrary, the weir plates longer sideways as aforementioned prevent the entanglement of the upper and lower wires during the winding operation of the solid wire around the drums and facilitate the winding operation. Further, the liquid surface of the electrolyte is maintained at a sufficient height of not impairing the electroplating quality and the workability of the wire and, as a result, the wires in multiple stages can be wound around the drums and the production quantity is enhanced remarkably. Furthermore, the appropriate discharge of the electrolyte through the passage holes of the weir plates acts to stir the electrolyte of the tank and serves advantageously to enhance the quality of the electroplating and the allowable current density.

As mentioned above, the wire to be treated is repeatedly subjected to bending on the drums during the electroplating process, reaching up to hundreds of times with large scale equipment, and the wire may produce a bending fatigue and breaking at the welding portion between the coils of the wire inevitable to the continuous operation. It is because the welding usually adopts the butt welding which decreases the strength locally.

Thus, it is necessary to subject the wire to be treated to drawing before entry into the drum group in order to strengthen the welded portion. On that occasion, it is necessary to carry out the working at the reduction in area of more than 5% and preferably of more than 10~39%.

Therefore, the introduction of the drawing process (B) of FIG. 1 gives further a certain back tension to the wire together with an action of straightening and effects to realize stably a running of a high density in the drum groups.

The present invention is now described with reference to the following examples.

EXAMPLE 1

A brass wire of 2.3 mm diameter was plated with tin of 30 microns in thickness at a wire speed of 50 m/min. The construction of the plating equipment comprised the processes of FIG. 1 and the plating section was also the same as the construction of FIGS. 2~4. A wire of 2.6 mm diameter (a) supplied from an uncoiler was drawn with a single die of 2.3 mm in diameter at a wire speed of 50 m/min., degreased with cathode in NaOH aqueous solution of 80° C. for two seconds, washed with water for one second, pickled in 5% $H_2SO_4$ aqueous solution for 0.5 second, and then led into a first group of a pair of drums without a water washing. The drums were made of 450 mm diameter by 700 mm high stainless steel and provided with 50 concave grooves with a pitch of 10 mm. An electroplating cell was 1500 mm in length and tin plates as anodes were placed therein at opposite sides of the wire. The tin plates and the drums were connected respectively with plus and minus of a DC power source. The end of the electroplating cell was provided with a slit of 75 mm in width in which weir plates longer sideways of 100×10×10 mm made of silicon nitride were piled up so as to put the wire between upper and lower plates. A passage hole for the wire was a circle made by joining semicircles of 5 mm at mininum diameter and an inner surface of the hole was finished at 1.2 S. An electrolyte contains 100 g/l of $H_2SO_4$, 80 g/l of $SnSO_4$ and 5 g/l of glue at 15° C., and the electrolyte overflowed out of passage holes of the weir plates was circulated by a pump through a storage tank. An electric current to each group of drums used a DC of 1,000 A. A wire delivered from a top of a first group of drums was guided to the bottom of a second group of drums by way of two guide drums for adjusting a different level made of stainless steel, each 200 mm in diameter. Individual drums were connected by a chain and driven by a motor through a torque limiter. The wire delivered from a third group of drums was washed with water for one second, dried by hot air for two seconds and then coiled up by a recoiler.

EXAMPLE 2

Wires of various diameters, butt-welded, were made to pass through the above process line and the following results were obtained.

| | Wire dia. | Reduction in area (%) | Result |
|---|---|---|---|
| No. 1 | 2.3 mm | 0% | Breaking of wire occurred in the first group of drums |
| No. 2 | 2.35 mm | 4% | Breaking of wire occurred in the third group of drums |
| No. 3 | 2.4 mm | 8% | No breaking of wire occurred |
| No. 4 | 2.5 mm | 15% | No breaking of wire occurred |

EXAMPLE 3

In the Example 1, the electroplating cell of the third group of drums used weir plates made of PVC and at a finishing degree of 10 S, and provided with small passage holes of 3.0 mm in diameter. The plated wires obtained were drawn up to 0.6 mm diameter and then annealed, and produced with blisters on the surfaces of the wires.

This invention has the advantage of providing an improved method and apparatus for continuously electroplating wire wherein vertical drums combine a power supply and turn direction. Also horizontal weir plates forming joints therebetween are provided for reducing the flow of electrolyte through the weir plates.

What is claimed is:

1. A continuous electroplating method for wire, comprising the steps of providing at least one group of vertical, rotatable drums comprising two or more drums; connecting said drums to the cathode side of an electric power supply running a conductive wire between said drums spirally from the bottom toward the top in multiple stages; and passing said conductive wire repeatedly through an electrolyte of an electroplating electrolytic cell positioned between said drums; wherein back end of said electroplating electrolytic cell is provided with a vertically oriented slit to allow the passage of said conductive wire through the cell, each slit having a plurality of horizontally oriented weir plates that are placed one on top of the other within the slits at each end of the cell, said slits being substantially closed by said horizontally oriented weir plates; said weir plates having a vertical line of wire passage holes for running said conductive wires in multiple stages through said cell, the holes being formed at joint surfaces between individual adjacent weir plates enclosing the wire circumference.

2. A method according to claim 1, wherein said conductive wire or the like is drawn prior to electroplating.

3. A method according to claim 2, wherein the drawing produces a reduction in area of at least above about 5%.

4. A method according to claim 1, wherein the weir plates are made of a ceramic material.

5. A method according to claim 4 wherein holes of said weir plates for said wire to be electroplated are finished to a polishing degree sufficient substantially to prevent roughness and wear due to contact with the wire, as well as simultaneously to prevent scoring and straining of the electroplated surface of the wire.

6. A continuous electroplating apparatus for wire, comprising means for continuously supplying a conductive wire, means for drawing said wire, for pretreatment of said wire, for electroplating said wire, for post-treatment of said wire, and for taking up said wire being successively positioned, wherein the means for electroplating includes at least one group of drums comprising two or more drums, an electric power supply, a connection between said power supply and said drums, each of said drums being vertically oriented and rotatable, said drums being adapted to wind and run said wire to be electroplated from the bottom to the top of the drums in multiple stages; and wherein an electroplating cell is provided between at least some of said drums for immersing and running said wire to be electroplated in multiple stages in an electrolyte of said cell for carrying out an electroplating; and each end of said electroplating cell is provided with a vertical slit for passage of said wire to be electroplated, each slit being provided with horizontally oriented weir plates one on top of the other within the slit, said weir plates having a vertical line of wire passage holes at joints of individual weir plates to form a passage for said wire, said holes being adapted to enclose the wire circumference to substantially close the slit.

7. An apparatus according to claim 6 including at least two groups of drums and plural level adjustment rolls, each having a horizontal and rotatable shaft, are provided between former and latter groups of drums so as to guide a wire to be electroplated so as to be delivered from a top step of said former group of drums to a bottom step of said latter group of drums.

8. A continuous electroplating apparatus having an electroplating electrolytic cell containing an electrolyte for electroplating wire, comprising at least one group of two or more vertical rotatable drums; an electric power supply and a connection between said power supply and said drums; a conductive wire to be electroplated; the wire being wound by running it on said drums spirally from the bottom toward the top in multiple stages; said conductive wire being arranged to pass repeatedly through the electrolyte of the electroplating electrolytic cell, which is positioned between said drums; and each end of said electroplating electrolytic cell being provided with a vertically oriented slit having a plurality of horizontally oriented weir plates that are placed one on top of the other within the slit for the passage of said conductive wire, said slits being closed with said horizontally oriented weir plates that are longer sideways than they are vertically in such a manner that said weir plates separate the running conductive wire into multiple stages running through the cell between upper and lower plates to pass in and out of said electroplating electrolytic cell through a vertically oriented line of wire-passage holes for running said conductive wire therethrough in multiple stages, said holes being respectively formed at joint surfaces between adjacent individual weir plates enclosing the wire circumference, and wherein said weir plates are made of a ceramic.

9. The apparatus of claim 8 in which the vertical line of wire-passage holes fomred by adjacent weir plates includes at least one semicircle in one weir plate.

10. The apparatus of claim 9 in which the vertical line of wire-passage holes are circular holes formed by adjacent semi-circles in adjacent weir plates.

11. The apparatus of claim 10 in which the vertical line of wire-passage holes are located one over another.

12. The apparatus of claim 11 in which there is only one strand of wire through each horizontally oriented wire-passage hole in each horizontal joint between the weir plates.

13. The apparatus of claim 12 in which the drums are oriented to successively wind the wires step-wise from a former drum group to a latter drum group.

14. The apparatus of claim 13 in which the wire is successively wound from a top step of a former drum group to a bottom step of a latter drum group.

* * * * *